US007371094B1

(12) United States Patent
Tokuhashi et al.

(10) Patent No.: US 7,371,094 B1
(45) Date of Patent: May 13, 2008

(54) ALIGNED CONTACT GROUP AND ELECTRICAL CONNECTOR FOR FLEXIBLE SUBSTRATE

(75) Inventors: Daisuke Tokuhashi, Tokyo (JP); Hisatomo Mima, Hadano (JP); Toshinori Ameya, Hadano (JP)

(73) Assignees: DDK Ltd., Tokyo (JP); Hitachi Ltd., Tokyo (JP)

( * ) Notice: Subject to any disclaimer, the term of this patent is extended or adjusted under 35 U.S.C. 154(b) by 0 days.

(21) Appl. No.: 11/645,293

(22) Filed: Dec. 22, 2006

(51) Int. Cl.
*H01R 13/15* (2006.01)

(52) U.S. Cl. ..... 439/260; 439/329; 439/492

(58) Field of Classification Search ..... 439/260–261, 439/329, 492

See application file for complete search history.

(56) References Cited

U.S. PATENT DOCUMENTS 4,165,909 A * 8/1979 Yeager et al. ..... 439/260
4,275,944 A * 6/1981 Sochor ..... 439/267
4,696,529 A * 9/1987 Verhoeven et al. ..... 439/267
4,720,156 A * 1/1988 Beers ..... 439/260
4,804,334 A * 2/1989 Alexeenko et al. ..... 439/260

FOREIGN PATENT DOCUMENTS

FR 0068196 * 6/1982

* cited by examiner

*Primary Examiner*—Truc Nguyen
(74) *Attorney, Agent, or Firm*—Abelman, Frayne & Schwab

(57) ABSTRACT

An electrical connector includes contacts each having a junction to be electrically connected to another substrate and a pair of contact portions bifurcated and extending from the junction to form a bearing space therebetween, and an array plate for forming thereon a contact group by aligning a plurality of the contacts in a particular direction, and a cam shaft positioned and rotatably held within the bearing spaces of the contacts aligned with one another on the array plate to form a contact group and having a major axis portion and a minor axis portion different in size such that former is larger and the latter is smaller than the width of the bearing spaces so that the cam shaft is axially insertable into and retractable from the bearing spaces of the contacts. With this construction, the contacts can be detachably fitted in a connector so that failed contacts can be easily replaced with new contacts.

11 Claims, 7 Drawing Sheets

ALIGNED CONTACT GROUP AND ELECTRICAL CONNECTOR FOR FLEXIBLE SUBSTRATE

BACKGROUND OF THE INVENTION

This invention relates to an aligned contact group and an electrical connector for a flexible substrate, which enable the flexible substrate such as a flexible printed circuit board and a flexible flat cable to be inserted into spacing between contact portions of contacts without requiring any insertion force and further securely achieve reliable electrical connection of the contacts and electrodes formed on surfaces of a flexible substrate.

In an electrical connector for a flexible substrate of prior art, if a large insertion force is required upon inserting the flexible substrate into the connector, the substrate would be greatly bent because the force could not be sufficiently transmitted into the insertion direction due to flexibility of the substrate, whereby the substrate could not be inserted into a correct connection position in a slot. As a result, it is impossible to achieve good electrical connection between electrodes of the substrate and contact portions of contacts arranged in the slot. Therefore, it is desirable that such an electrical connector has a structure enabling a substrate to be inserted into the connector without requiring any insertion force, that is, with a so-called "zero-insertion force".

An electrical connector having a structure by which a substrate can be inserted with zero-insertion force has been disclosed in Japanese Patent Application Opened No. 2004-48,905 (Patent Literature 1). The electrical connector disclosed in the Patent Literature 1 includes between flexible arms of contacts an actuator which is displaceable by driving. The flexible arms of the contacts are set to an opened and a closed condition by pivotally moving the actuator into predetermined positions. In the opened condition, the leading end of another connector is inserted into the connector to achieve fitting and connection of two connectors with zero-insertion force.

On the one hand, an electrical connector generally employs a plurality of contacts installed in a housing.

In an electrical connector used for the purpose of loading a plurality of flexible substrates, on the other hand, it is required to accurately arrange contacts with a high accuracy in order to effect reliable fitting with the flexible substrates. In the case that positional accuracy is relied upon a housing, insufficiently fitted contacts partly occur owing to a widened loading area of the contacts. Sometimes, therefore, contacts have been used in the state that a plurality of contacts are aligned with one another on an array plate. Such an electrical connector has advantages that spacing between arranged contacts can be narrowed and flexible arms of another connector can be protected from being deformed by external forces. However, since a cam shaft and an operating lever for rotating the cam shaft are mounted together with the aligned contact group, the cam shaft and the operating lever could not be removed so that an occupied area (space) at mounting place of the electrical connector (for example, onto other substrate) becomes greater. Such problems remain to be solved.

SUMMARY OF THE INVENTION

It is an object of the invention to provide an aligned contact group and an electrical connector for a flexible substrate having a structure which enables a flexible substrate such as a flexible printed circuit board and a flexible flat cable to be inserted into a space between contact portions of contacts with zero-insertion force and enables contacts to be arranged in aligned relationship to one another with any desired spacing and is easy to ascertain a soldered condition after a contact group being formed. In particular, according to the aligned contact group and the electrical connector for a flexible substrate intended to provide by the present invention, the contacts can be detachably loaded by achieving consistent relationship between the contacts and the cam shaft so that even if failure of the contacts occurs, the failed contacts can be easily replaced with new contacts.

In order to achieve the above object, the aligned contact group according to the invention comprises contacts each including a junction to be electrically connected to another substrate and a pair of contact portions bifurcated and extending from said junction and each having at a tip at least one electric contact adapted to be electrically connected to an electrode formed on a surface of an inserted flexible substrate, and an array plate for forming thereon a contact group by substantially aligning a plurality of said contacts in a particular direction, and each of said contacts forming said contact group having a bearing space located between both said contact portions nearer to said junction than do said electric contacts, said bearing space for rotatably positioning and holding therein a cam shaft in the form of bar which is axially insertable into and retractable from the bearing space.

The cam shaft preferably has a major axis portion and a minor axis portion different in size such that the former is larger and the latter is smaller than the width of said bearing spaces.

As an practical structure of the aligned contact group, it is preferably configured in a manner that said contacts are made of an elastic conductive material, that in inserting the flexible substrate into spaces between both the contact portions of the contacts forming said contact group, said cam shaft is rotated within said bearing spaces and said major axis portion of the cam shaft is held in a position where said major axis portion is opposed to both the contact portions so that both the contact portions of the contacts forming said contact group are spread by the action of the outer surfaces of the cam shaft so as to widen spacing between said electric contacts of both the contact portions to be wider than the thickness of said flexible substrate, thereby enabling the flexible substrate to be inserted between the electric contacts without requiring any insertion force, and that in electrically connecting electrodes of the inserted flexible substrate to the electric contacts of the contacts forming said contact group, said cam shaft is rotated within said bearing spaces to a position where the minor axis portion of said cam shaft is opposed to both the contact portions so that both the contact portions of the contacts forming said contact group are elastically restored such that the spacing between the electric contacts of said contact portions becomes narrower than the thickness of said flexible substrate, thereby electrically connecting the electrodes of the flexible substrate and the electric contacts of said respective contacts.

With the aligned contact group, said cam shaft is preferably provided at one end with a detachable operating lever for rotating the cam shaft, and/or said contacts are each more preferably provided with projections at the portion defining said bearing space for preventing the cam shaft from moving in longitudinal direction of said contact portions.

The electrical connector according to the invention comprises contacts each including a junction to be electrically connected to another substrate and a pair of contact portions bifurcated and extending from said junction and each having at a tip at least one electric contact adapted to be electrically connected to an electrode formed on a surface of the inserted flexible substrate, and said contacts each further including a bearing space located between these contact portions nearer to said junction than do said electric contacts; an array plate for forming thereon a contact group by substantially aligning a plurality of said contacts in a particular direction; and a cam shaft in the form of a bar rotatably positioned and held within said bearing spaces of said contacts aligned with one another on said array plate to form a contact group, and having a major axis portion and a minor axis portion different in size such that the former is larger and the latter is smaller than the width of said bearing spaces of both the contact portions, and said cam shaft being axially insertable into and retractable from said bearing spaces of said contacts forming said contact group.

According to the invention, there is provided with a structure which enables a flexible substrate such as a flexible printed circuit board and a flexible flat cable to be inserted into a space between contact portions of contacts with zero-insertion force and enables contacts to be arranged in aligned relationship to one another with any desired spacing and is easy to ascertain a soldered condition after a contact group being formed. Particularly, it becomes possible to obtain an aligned contact group and an electrical connector whose contacts can be detachably fitted in a connector by achieving the consistent relationship between the contacts and the cam shaft so that failed contacts can be easily replaced with new contacts.

Moreover, the invention has advantages of the improved operationality, miniaturization of connector and reduced occupied area upon mounting a substrate by providing a detachable operating lever at one end of the cam shaft for rotating the cam shaft.

According to the invention, moreover, the cam shaft can be positioned in the bearing spaces of the contacts with higher accuracy by providing the projections at the portions defining the bearing spaces of the contacts for preventing the cam shaft from moving in the longitudinal direction of the contact portions of the contacts.

The invention will be more fully understood by referring to the following detailed specification and claims taken in connection with the appended drawings.

DESCRIPTION OF THE PREFERRED EMBODIMENTS

Figure 1:
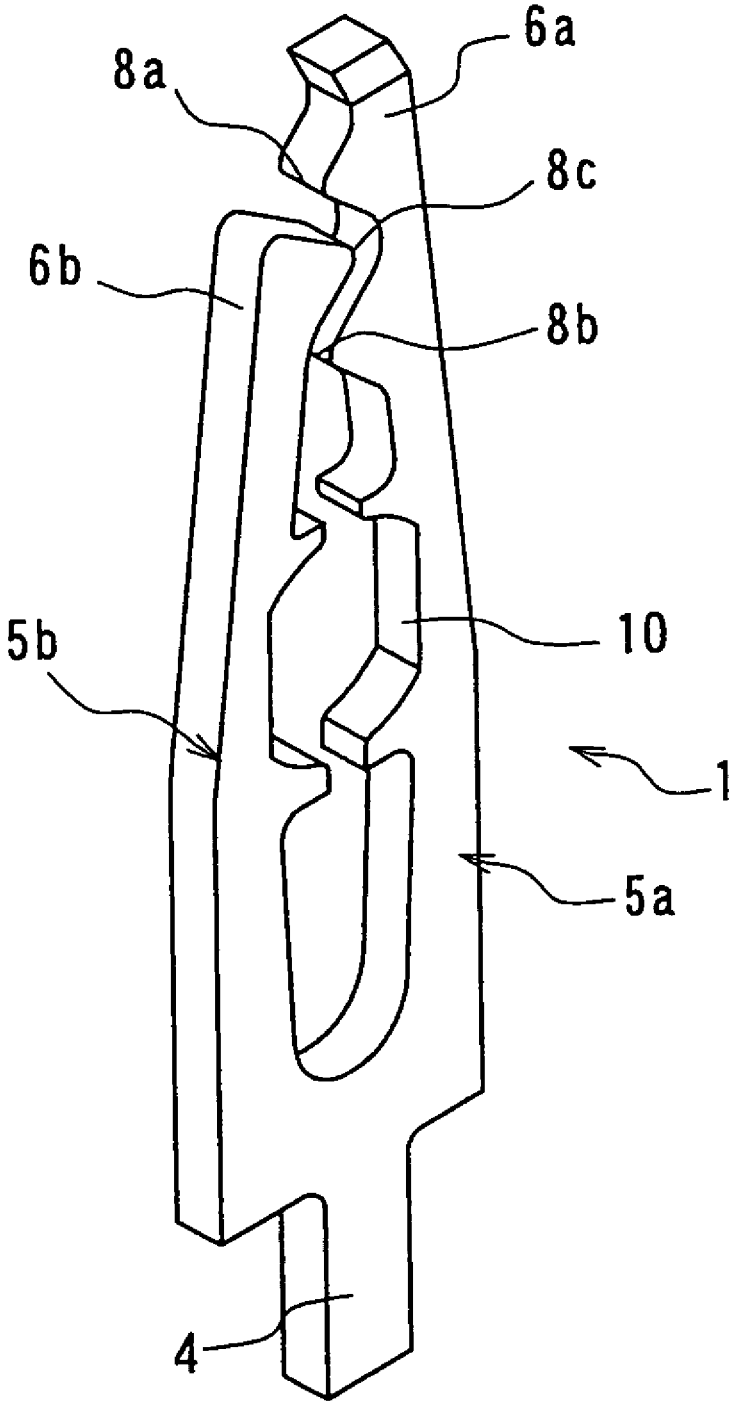
FIG. 1 is a perspective view of one contact to be used in the electrical connector according to the invention.
Figure 2:
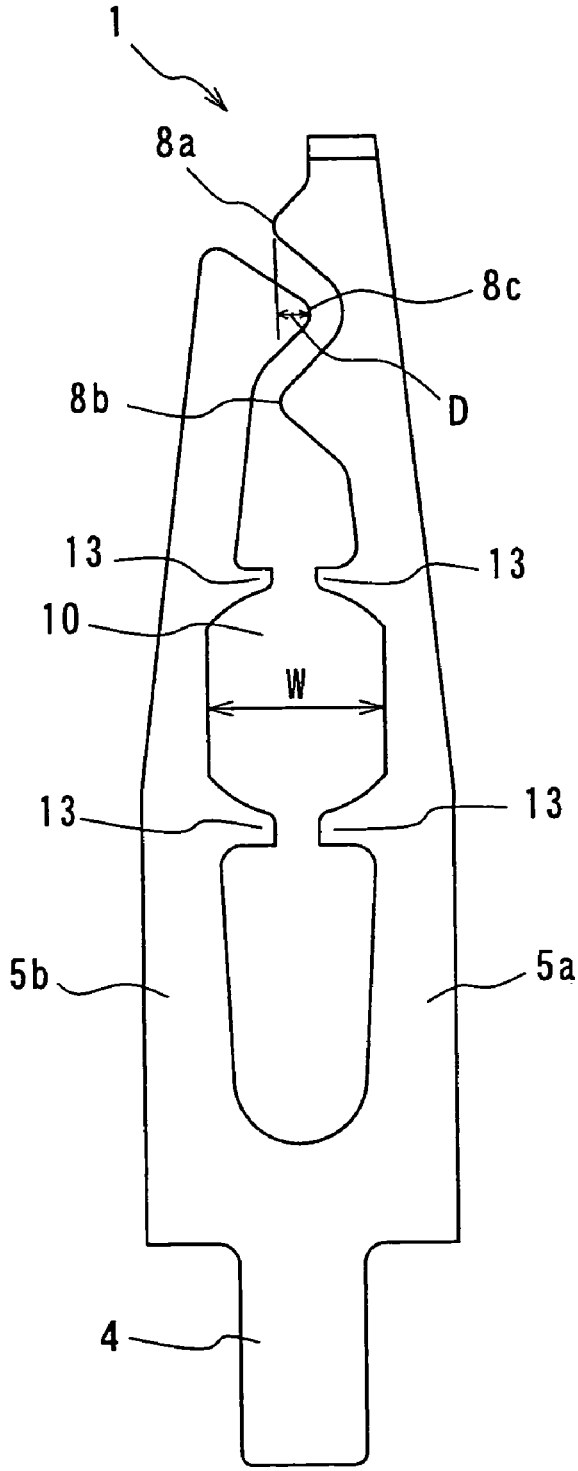
FIG. 2 is a plan view of the contact shown in FIG. 1.
Figure 3:
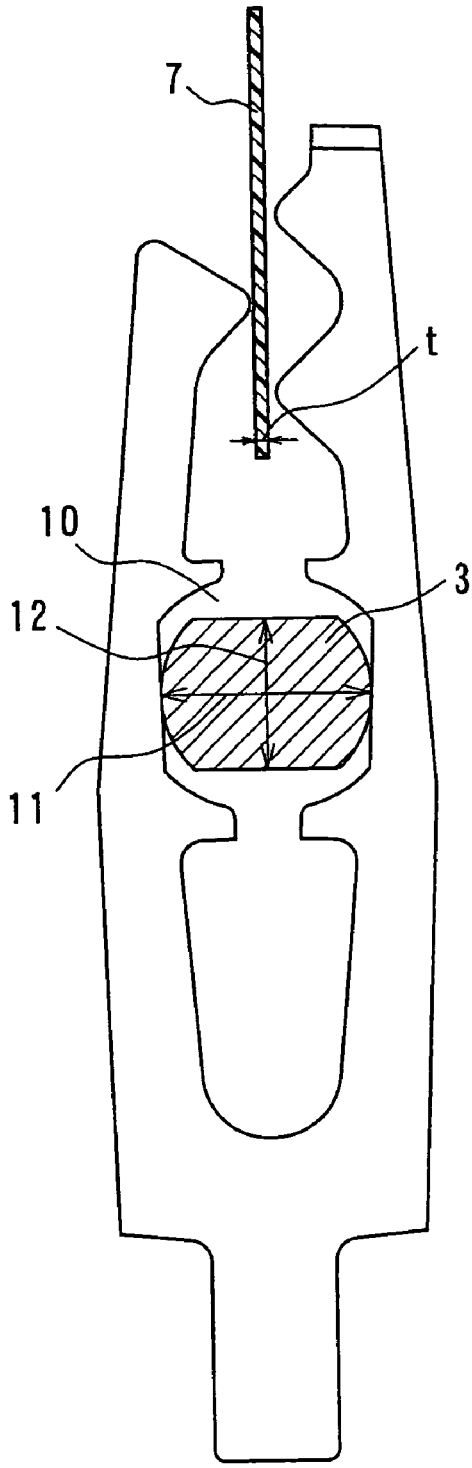
FIG. 3 is a plan view illustrating a situation when a flexible substrate is being inserted into a space between contact portions of the contact shown in FIG. 1.
Figure 4:
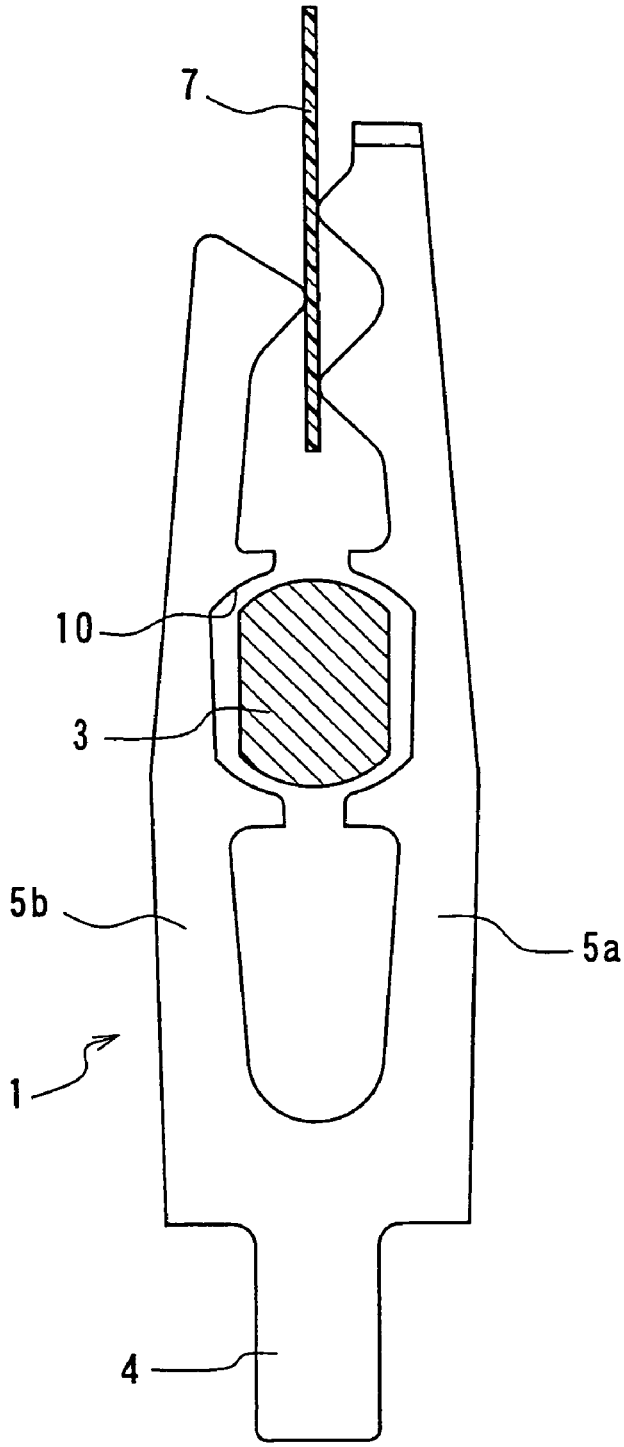
FIG. 4 is a plan view illustrating a situation upon electrically connecting after the flexible substrate has been inserted.

The best mode for carrying out the invention will be explained with reference to the drawings hereinafter FIGS. 1 to 4 illustrate one of contacts for forming a typical aligned contact group according to the invention. FIG. 1 is a perspective view and FIGS. 2 to 4 are plan views.

The aligned contact group according to the invention comprises contacts 1 and an array plate 2, while the electrical connector according to the invention comprises the above components 1 and 2 and, in addition, a cam shaft 3.

The contacts 1 are made of an elastic material having a high strength, high bending performance, and conductivity, for example, phosphor bronze, beryllium copper, brass and the like. The contacts 1 each comprise a junction 4 and a pair of contact portions 5*a* and 5*b*. The junction 4 is a part of the contact, which is electrically connected to another substrate (not shown) by soldering and the like.

The contact portions 5*a* and 5*b* are bifurcated and extend from the junction 4, and their tips 6*a* and 6*b* are each provided with at least one electric contact adapted to electrically connected to one of electrodes (not shown) formed on one surface of an inserted flexible substrate 7. FIG. 1 shows the contact having two electric contacts 8*a* and 8*b* on one contact portion 5*a* and one electric contact 8*c* on the other contact portion 5*b*, i.e. a total of three electric contacts 8*a*, 8*b* and 8*c*.

The contacts 1 each have a bearing space 10 located between both the contact portions 5*a* and 5*b* nearer to the junction 4 than do the electric contacts 8*a*, 8*b* and 8*c* for positioning and rotatably holding the cam shaft 3.

Figure 5A:
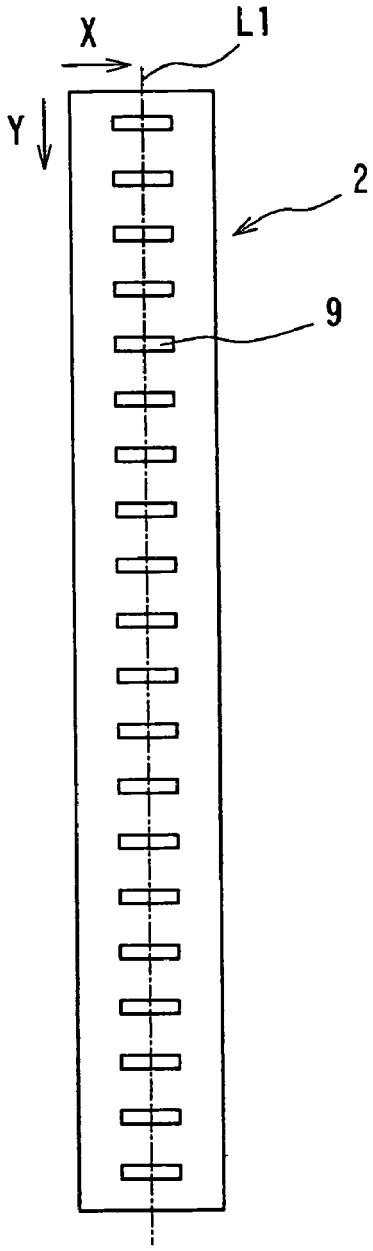
FIG. 5*a* is a plan view of an array plate to be used in the electrical connector according to the invention.
Figure 5B:
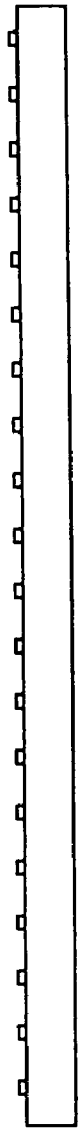
FIG. 5*b* is a side view of the array plate shown in FIG. 5*a* viewed from the right.
Figure 5C:
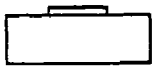
FIG. 5*c* is a front view of the array plate shown in FIG. 5*a;*

The array plate 2 is made of an insulating material similar to that of a substrate or the like and of a flat shape as shown in FIG. 5 on which a plurality of the contacts 1 are arranged thereon and substantially aligned with one another in a particular direction (direction Y in FIG. 5) to form a contact group. The expression "substantially aligned" is intended to include a case that centers of contact arrangement patterns are arranged so as to be alternately staggered with respect to a phantom center line L1 (FIG. 5*a*) which is at the center of the width of the array plate 2, in addition to the case as shown in FIG. 5*a* that the contacts 1 are arranged in contact arrangement patterns 9 whose centers coincide with the phantom center line L1.

With the array plate 2 shown in FIG. 5*a*, in order to substantially align the contacts 1 with one another in the direction Y in FIG. 5*a*, the contact arrangement patterns 9 are formed, whose number is the same as the number of the arranged contacts 1. In the case using the array plate 2 shown in FIG. 5*a*, a flexible substrate 7 is mounted along said phantom center line L1 which is at the center of the width of the array plate.

Figure 6:
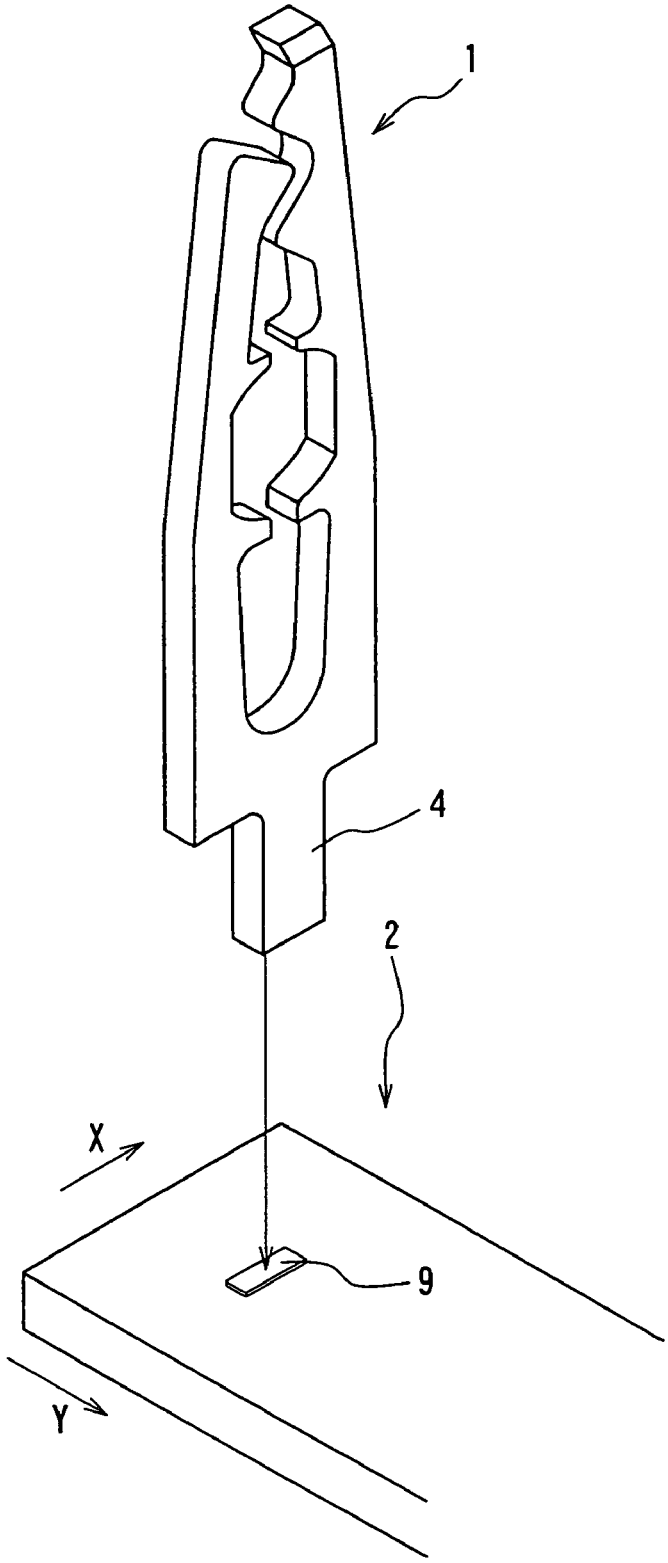
FIG. 6 is a perspective view illustrating a situation when a contact is mounted on the array plate in an arrangement pattern.

Further, FIG. 6 illustrates the situation when one contact 1 is being mounted on one of the contact arrangement patterns 9 of the array plate 2 shown in FIG. 5*a*.

Figure 7A:
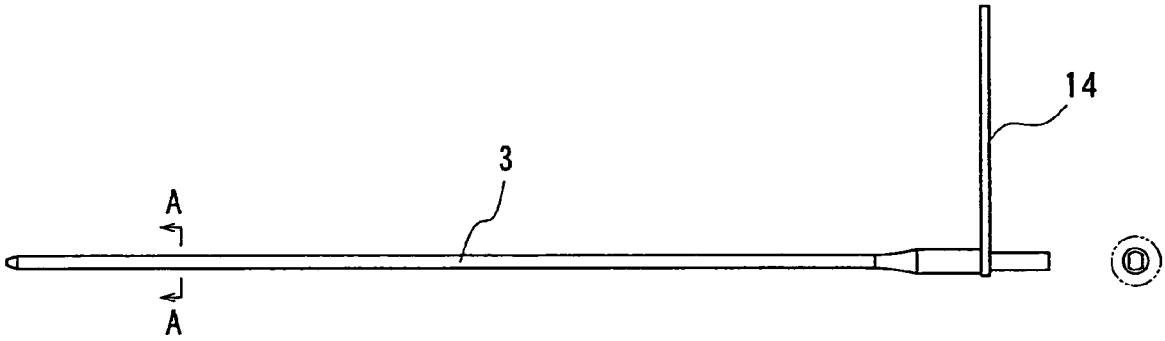
FIG. 7*a* is a front view of one example of a cam shaft and an operating lever according to the invention.
Figure 7B:
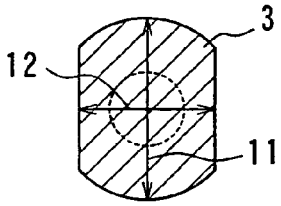
FIG. 7*b* is a sectional view of the cam shaft taken along the line A-A in FIG. 7*a*.
Figure 7C:
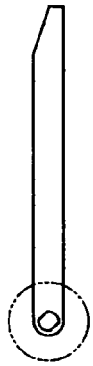
FIG. 7*c* is a side view of the cam shaft and the operating lever shown in FIG. 7*a*.

The cam shaft 3 is of a rod shape as shown in FIGS. 7*a* to 7*c* and is provided so as to be inserted into and removed from the bearing spaces 10 of the contacts 1 arranged in alignment with one another on the array plate 2 to form the contact group. As shown in FIG. 7*b*, the cam shaft 3 has a cross-section including a major axis portion 11 (FIG. 3) and a minor axis portion 12 different in thickness, the former being larger and latter being smaller than the spacing W (FIG. 2) of the bearing space 10 between both the contact portions 5*a* and 5*b*. The cross-section of the cam shaft 3 need only permit the cam shaft 3 to rotate about its longitudinal axis and have portions such as the major axis portion and the minor axis portion different in thickness, such as, for example, a rectangular or elliptical cross-section.

In the electrical connector according to the invention, when a flexible substrate 7 is inserted into the space between both the contact portions 5*a* and 5*b* of the contacts 1 forming said contact group, the cam shaft 3 is rotated in said bearing space 10 so that the major axis portion 11 of the cam shaft 3 is held in the position where the major axis portion 11 is opposed to and in contact with said contact portions 5*a* and 5*b* as shown in FIG. 3. In this way, both the contact portions 5*a* and 5*b* of the contacts forming said contact group are spread by the action of the outer surfaces of the cam shaft 3 to widen the distances between the electric contacts 8*a* to 8*c* of both the contact portions 5*a* and 5*b* so as to be wider than the thickness t of said flexible substrate 7, thereby enabling the flexible substrate to be inserted therebetween without requiring any insertion force, or with zero-insertion force.

In the case that electrodes of the inserted flexible substrate 7 are electrically connected to the electric contacts 8*a* to 8*c* of the contacts 1 forming said contact group, on the other hand, said cam shaft is rotated in said bearing spaces 10 so that the minor axis portion 12 of the cam shaft 3 is positioned in the position where the minor axis portion 12 is opposed to the contact portions 5*a* and 5*b* of the cam shaft 3 as shown in FIG. 4. Consequently, both the contact portions 5*a* and 5*b* of the contacts 1 forming said contact group are elastically restored toward each other, with the result that the distances D between the electric contacts of the contact portions 5*a* and 5*b* become narrower than the thickness t of said flexible substrate, thereby enabling the electric contacts 8*a* to 8*c* of the respective contacts 1 to be electrically connected to the electrodes of the flexible substrate 7. Moreover, said distance D means the shortest distance between the crest of the electric contact 8*c* of the contact portion 5*b* and a line connecting the crests of the two electric contacts 8*a* and 8*b* of the contact portion 5*a* as shown in FIG. 2. If the value of the distance D is minus (−), the crest of the electric contact 8*c* is positioned on the side of the contact portion 5*a* with respect to the line connecting the crests of the two electric contacts 8*a* and 8*b*.

In addition, the contact portions 5*a* and 5*b* are preferably provided with projections 13 at portions of the contact 1 defining the bearing space 10 for preventing the cam shaft 3 from moving in the longitudinal direction of said contact portions 5*a* and 5*b* for the purpose of stabilizing the rotation of the cam shaft 3. In order to prevent the movement of the cam shaft 3 in the longitudinal direction of the contact portions 5*a* and 5*b*, in FIG. 1 the four corners defining the bearing space 10 of the contact 1 are each provided with one projection 13. However, the number, positions and the like of the projections 13 are not limited to those shown in FIG. 1 but can be suitably selected depending upon requirements.

According to the invention, moreover, under the condition that the cam shaft 3 does not act on the contact portions 5*a* and 5*b* of the contact, it is possible to remove the cam shaft 3 in its axial direction from the bearing spaces 10 of the contacts 1. Therefore, this configuration has an advantage of enabling failed contacts to be replaced by removing the cam shaft 3 from the bearing spaces 10 of the contacts 1 forming the aligned contact group.

Moreover, it is preferable to provide an operating lever 14 at one end of the cam shaft 3 for providing a turning force to the cam shaft 3 as shown in FIGS. 7*a* to 7*c*. The operating lever 14 may be of any shape insofar as it serves to rotate the cam shaft 3.

In addition, according to the invention the operating lever 14 is configured to be detachable from the cam shaft 3, for example, by the use of gear-shaped engaging means. Such a detachable operating lever 14 has advantages of improved operationality, miniaturization of connector, reduced occupied area upon mounting a substrate.

In addition, although the invention has been particularly shown and described with reference to the preferred embodiment thereof, it will be understood by those skilled in the art that the foregoing and other changes in form and details can be made therein without departing from the spirit and scope of the following claims. For example, while the contacts 1 are shown in FIGS. 1 to 4 to have the contact portions 5*a* and 5*b* movable away from each other by the action of the cam shaft 3, it will be apparent that the two upper projections among the four projections 13 as shown in FIG. 2 may be connected and formed to have an elasticity so that the contact portions 5*a* and 5*b* are reversely moved to close each other when subjected to the action of the cam shaft 3.

The aligned contact group and the electrical connector for a flexible substrate according to the invention have the structure by which a flexible substrate such as flexible printed circuit board or flexible flat cable can be inserted into a connector or between contact portions of contacts without any insertion force (or by zero-insertion force). Particularly, contacts can be detachably fitted in a connector by achieving the consistent relationship between the contacts and the cam shaft so that failed contacts can be easily replaced with new contacts.

Moreover, the invention has the advantages of the improved operationality, miniaturization of connector and reduced occupied area upon mounting a substrate by providing a detachable operating lever at one end of the cam shaft for rotating the cam shaft.

According to the invention, moreover, the cam shaft can be positioned in the bearing spaces of the contacts with higher accuracy by providing the projections at the portions defining the bearing spaces of the contacts for preventing the cam shaft from moving in the longitudinal direction of the contact portions of the contacts.

What is claimed is:

1. An aligned contact group comprising:

contacts each including a junction to be electrically connected to another substrate and a pair of contact positions bifurcated and extending from said junction and each having at a tip at least one electric contact adapted to be electrically connected to an electrode formed on a surface of an inserted flexible substrate, and an array plate for forming thereon a contact group by substantially aligning a plurality of said contacts in a particular direction, and each of said contacts forming said contact group having a bearing space located between both said contact portions nearer to said junction than do said electric contact, said bearing space for rotatably positioning and holding therein a cam shaft in the form of rod which is axially insertable into and retractable from the bearing space.

2. The aligned contact group as set forth in claim 1, wherein said cam shaft has a major axis portion and a minor axis portion different in size such that the former is larger and the latter is smaller than the interval of said bearing spaces.

3. The aligned contact group as set forth in claim 1, wherein said contacts are made of an elastic conductive material, wherein in inserting the flexible substrate into spaces between both the contact portions of the contacts forming said contact group, said cam shaft is rotated within said bearing spaces and said major axis portion of the cam shaft is held in a position where said major axis portion is opposed to both the contact portions so that both the contact portions of the contacts forming said contact group are spread by the action of the outer surfaces of the cam shaft so as to widen spacing between said electric contacts of both the contact portions to be wider than the thickness of said flexible substrate, thereby enabling the flexible substrate to be inserted between the electric contacts without requiring any insertion force, and wherein in electrically connecting electrodes of the inserted flexible substrate to the electric contacts of the contacts forming said contact group, said cam shaft is rotated within said bearing spaces to a position where the minor axis portion of said cam shaft is opposed to both the contact portion so that both the contact portions of the contacts forming said contact group are elastically restored such that the spacing between the electric contacts of said contact portions becomes narrower than the thickness of said flexible substrate, thereby electrically connecting the electrodes of the flexible substrate and the electric contacts of said respective contacts.

4. An electrical connector for the flexible substrate as set forth in claim 1, wherein said cam shaft is provided at one end with a detachable operating lever for rotating the cam shaft.

5. An electrical connector for the flexible substrate as set forth in claim 1, wherein said contacts are each provided with projections at the portion defining said bearing space for preventing the cam shaft from moving in longitudinal direction of said contact portions.

6. An electrical connector for the flexible substrate as set forth in claim 2, wherein said cam shaft is provided at one end with a detachable operating lever for rotating the cam shaft.

7. An electrical connector for the flexible substrate as set forth in claim 3, wherein said contacts are each provided with projections at the portion defining said bearing space for preventing the cam shaft from moving in longitudinal direction of said contact portions.

8. An electrical connector for the flexible substrate as set forth in claim 2, wherein said contacts are each provided with projections at the portion defining said bearing space for preventing the cam shaft from moving in longitudinal direction of said contact portions.

9. An electrical connector for the flexible substrate as set forth in claim 3, wherein said contacts are each provided with projections at the portion defining said bearing space for preventing the cam shaft from moving in longitudinal direction of said contact portions.

10. An electrical connector for the flexible substrate as set forth in claim 4, wherein said contacts are each provided with projections at the portion defining said bearing space for preventing the cam shaft from moving in longitudinal direction of said contact portions.

11. An electrical connector for the flexible substrate comprising:

contacts each including a junction to be electrically connected to another substrate and a pair of contact portions bifurcated and extending from said junction and each having at a tip at least one electric contact adapted to be electrically connected to an electrode formed on a surface of the inserted flexible substrate, and said contacts each further including a bearing space located between these contact portions nearer to said junction than do said electric contacts, an array plate for forming thereon a contact group by substantially aligning a plurality of said contacts in a particular direction, and a cam shaft in the form of a bar rotatably positioned and held within said bearing spaces of said contacts aligned with one another on said array plate to form a contact group, and having a major axis portion and a minor axis portion different in size such that the former is larger and the latter is smaller than the interval of said bearing spaces of both the contact portions, and said cam shaft being axially insertable into and retractable from said bearing spaces of said contacts forming said contact group.

* * * * *